United States Patent [19]

Kayyod et al.

[11] Patent Number: 4,711,156

[45] Date of Patent: Dec. 8, 1987

[54] ACTUATOR FOR CONVERTING LINEAR MOTION TO ROTARY MOTION AND VICE VERSA

[75] Inventors: Fariborz Kayyod; Richard J. Stuart; Jeffrey D. Ogden, all of Anderson, Ind.

[73] Assignee: General Motors Corporation, Detroit, Mich.

[21] Appl. No.: 6,357

[22] Filed: Jan. 12, 1987

Related U.S. Application Data

[63] Continuation of Ser. No. 741,467, Jun. 5, 1985, abandoned.

[51] Int. Cl.[4] ..... F01B 3/00

[52] U.S. Cl. ..... 92/31; 74/89.15; 92/99; 92/136; 92/163; 92/165 PR

[58] Field of Search ..... 92/31, 33, 94, 99, 165 PR, 92/98 R, 136, 140, 163, 166; 74/89.15, 99 R, 99 A, 109

[56] References Cited

U.S. PATENT DOCUMENTS

| | | | |
|---|---|---|---|
| 2,883,144 | 4/1959 | Kendig | 92/31 |
| 2,974,646 | 3/1961 | Miller . | |
| 3,097,608 | 7/1963 | Deibel | 92/31 |
| 3,508,472 | 4/1970 | Hartwick, Jr. | 92/31 |
| 3,989,223 | 11/1976 | Burkhardt | 92/33 |
| 4,004,299 | 1/1977 | Runge | 92/31 |
| 4,114,470 | 9/1978 | Sharpe | 74/441 |
| 4,193,337 | 3/1980 | Disdier | 92/31 |
| 4,230,025 | 10/1980 | Caliri | 92/31 |
| 4,325,535 | 4/1982 | Foster | 92/33 |
| 4,557,746 | 12/1985 | Braithwaite | 92/31 |
| 4,613,353 | 9/1986 | Voisine | 92/31 |

*Primary Examiner*—Abraham Hershkovitz
*Attorney, Agent, or Firm*—R. L. Phillips

[57] ABSTRACT

A linear to rotary actuator is disclosed having a fluid pressure operated diaphragm whose linear movement is translated into rotary movement of an output member by a helical coupling therebetween. The coupling comprises a coupling member that is insert molded in the diaphragm so as to extend therethrough and interlock therewith while preventing fluid from passing from one diaphragm side to the other. The coupling member has a combined guide and anti-rotation portion extending from one side of the diaphragm that slidably engages a stationary guide so as to guide linear movement while preventing rotational movement of the coupling member and further has a helix extending from the other side of the diaphragm which in one embodiment slidably engages in a slot directly in the output member whereby linear movement of the diaphragm forces linear non-rotational movement of the coupling member and thereby rotary movement of the output member. In another embodiment, the helix engages in a slot in a sector gear which meshes with a gear connected to the output member to turn same.

1 Claim, 10 Drawing Figures

ACTUATOR FOR CONVERTING LINEAR MOTION TO ROTARY MOTION AND VICE VERSA

This is a continuation of application Ser. No. 741,467, filed on June 5, 1985 now abandoned.

TECHNICAL FIELD

This invention relates to an actuator for converting linear motion to rotary motion and vice versa and more particularly to a helical coupling device for converting linear motion into rotary motion and vice versa.

BACKGROUND OF THE INVENTION

In actuators of the type having a diaphragm or piston whose linear movement is translated into rotary movement of an output member and vice versa for pressure produced or pressure producing action respectively by the diaphragm or piston, it is known to employ a helical coupling therebetween for effecting such motion conversion. Various designs of a helical coupling for effecting such motion conversion have been proposed but they are normally complicated in design and require many parts and considerable time in their assembly.

SUMMARY OF THE INVENTION

The present invention is an improved, integrated design of helical coupling for effecting totally within the actuator the conversion of linear movement of the diaphragm or piston into rotary movement of the output member and vice versa. In the present invention, the helical coupling comprises a simple coupling member that is insert molded in the diaphragm or piston so as to both extend therethrough and interlock therewith thereby avoiding the normal attachment with plates and fasteners. The coupling member is provided with a helix which extends from one side of the diaphragm or piston and slidably engages in a slot which in one embodiment is directly in the output member. The coupling member further has a combined guide and anti-rotation portion which extends from the other side of the diaphragm or piston and engages with a stationary mating member so as to guide linear movement while preventing rotational movement of the coupling member whereby linear movement of the diaphragm or piston forces linear non-rotational movement of the coupling member and thereby rotary movement of the output member and vice versa. In another embodiment, the helix slidably engages in a slot in a sector gear which meshes with a gear connected to the output member to turn same.

These and other objects, advantages and features of the present invention will be more apparent from the following description and drawings in which:

DETAILED DESCRIPTION OF THE PREFERRED EMBODIMENTS OF THE INVENTION

Figure 1:
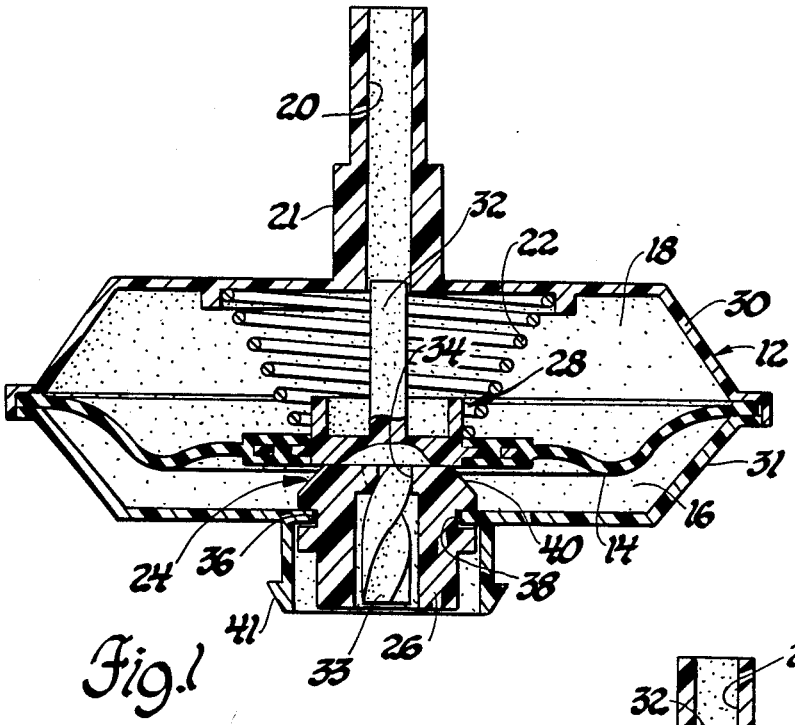
FIG. 1 is a cross-sectional view of one preferred form of the actuator according to the present invention and showing the diaphragm therein in its normal position.
Figure 2:
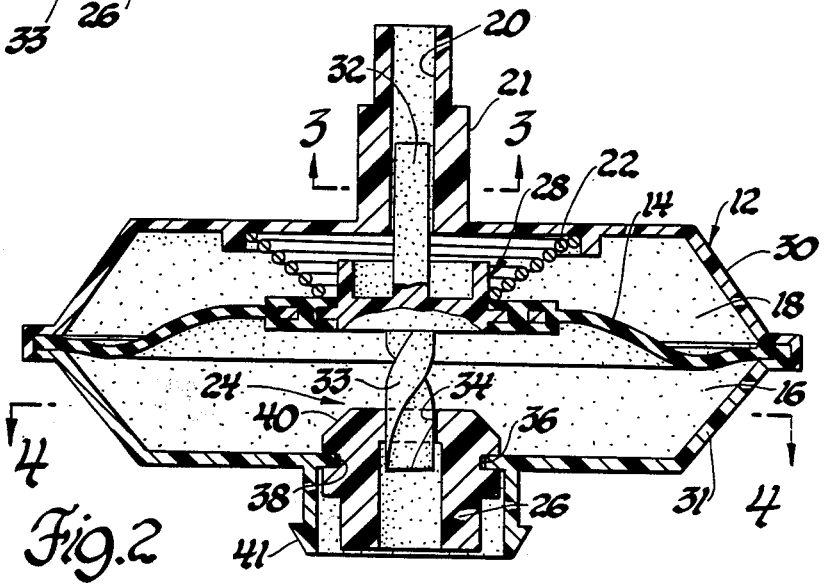
FIG. 2 is a view similar to FIG. 1 but showing the diaphragm in an actuating position.

Referring to FIG. 1, there is shown a vacuum type fluid pressure operated actuator constructed according to the present invention for use in a vehicle heating and/or air conditioning system to operate a pivotal air flow control door or valve (not shown). The actuator generally comprises a two-piece injection molded plastic casing 12 whose interior is divided by an elastomeric diaphragm 14 into a pair of chambers 16 and 18. The lower chamber 16 is vented to atmosphere and the upper chamber 18 is communicable with engine vacuum via a passage 20 through a nipple 21 integral with the casing. The diaphragm 14 is normally biased by a conical helical spring 22 to the one extreme position shown in FIG. 1 when the chamber 18 is at or near atmospheric but on the establishment of a subatmospheric pressure therein (vacuum), the resulting differential air pressure forces the diaphragm upward against the spring to an actuating position as shown in FIG. 2. As the diaphragm moves upwardly, a helical coupling assembly generally designated as 24 converts such linear diaphragm motion into rotary motion of an output member 26 that is rotatably supported in the lower end of the casing and is adapted to be connected external thereof to the device to be operated; in this case the previously mentioned air flow control door.

Figure 3:
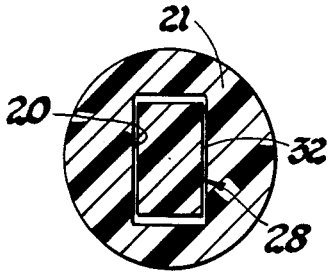
FIG. 3 is a view taken along the line 3—3 in FIG. 2.

Describing now the details of the helical coupling assembly 24, there is a coupling member 28 preferably made of injection molded plastic that is insert molded in the diaphragm 14 centrally thereof so as to extend therethrough and interlock therewith while preventing fluid from passing from one diaphragm side to the other between the chambers 16 and 18. The resulting subassembly comprising the diaphragm 14 and coupling member 28 is simply assembled in the casing by compressing the periphery of the diaphragm between the two casing halves 30 and 31 which are then ultrasonically welded together. The coupling member 28 has a centrally located, integral, upwardly extending stem 32 of rectangular cross-section that is slidable in the fluid passage 20 which is located concentric therewith. The passage 20 is formed with a corresponding cross-section (see FIG. 3) so as to require the coupling member 28 and thereby the diaphragm 14 to slide linearly (vertically in the Figures) without rotation and with there being provided sufficient clearance in this sliding fit so as not to significantly impede the air communication therethrough with the chamber 18.

Figure 4:
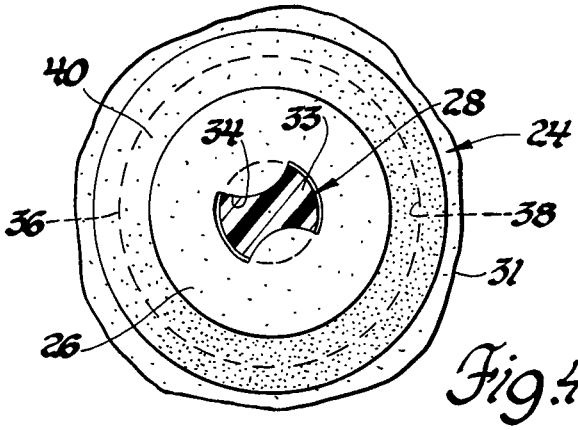
FIG. 4 is an enlarged view taken along the line 4—4 in FIG. 2.

In addition, the coupling member 28 has a centrally located, integral, helix 33 of double fluted cross-section extending downwardly from the other side of the diaphragm that slidably engages in a slot 34 of similar cross-section formed in the top end of the rotary output member 26 (see FIG. 4). The rotary output member 26 is rotatably mounted and axially retained in the case concentric with the coupling member by being provided with an annular groove 36 which is snap-fittingly received in an aperture 38 centrally located in the lower casing member 31, the upper end of the output member being provided with a chamfer 40 to ease such snap-fitting assembly. The lower casing member is also formed with a snap-fit collar 41 that extends about the output member and is adapted to attach the actuator relative to the device to be actuated.

With the guide and anti-rotation stem 32 positively preventing any rotation of the diaphragm subassembly when vacuum is applied to the chamber 18, the diaphragm assembly can thus only travel linearly (i.e. without rotation) which results in rotation of the output member 26 by operation of the helix 33 in the slot 34 and with the amount of rotary motion thus directly proportional to the amount of vacuum supply. Then when the vacuum is relieved, the spring 22 operates to return the actuator to its normal position in FIG. 1. In addition, different degrees of rotation of the output member can be obtained by simply providing the helix 33 with different pitches. In addition, by simply reversing the twist of the helix or thread, the actuator can be made to provide clockwise or counterclockwise rotation as desired.

Figure 5:
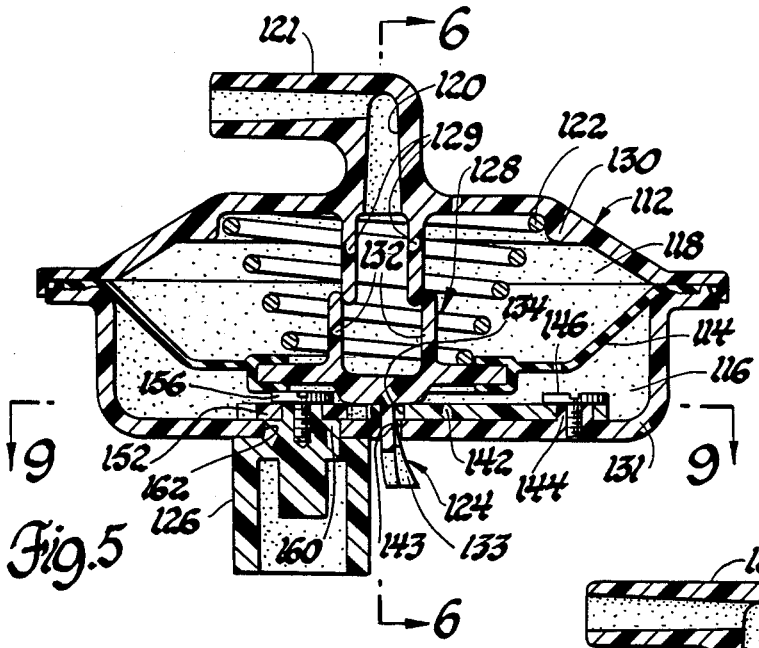
FIG. 5 is a cross-sectional view of another preferred form of the actuator according to the present invention and showing the diaphragm therein in its normal position.
Figure 7:
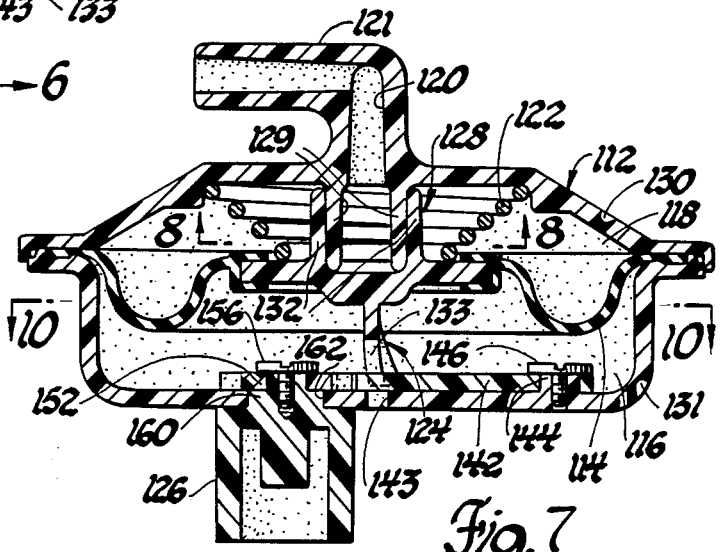
FIG. 7 is a view similar to FIG. 5 but showing the diaphragm in an actuating position.
Figure 9:
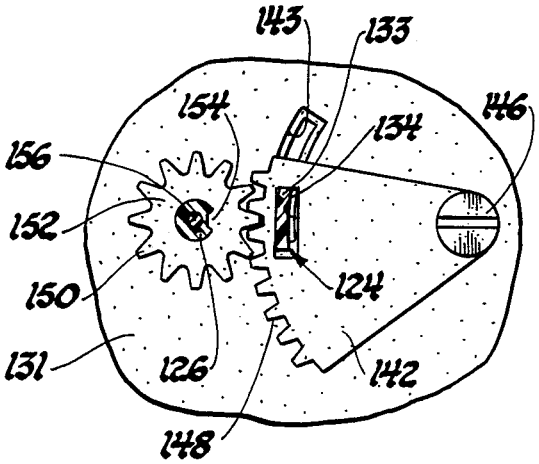
FIG. 9 is a view taken along the line 9—9 in FIG. 5.
Figure 10:
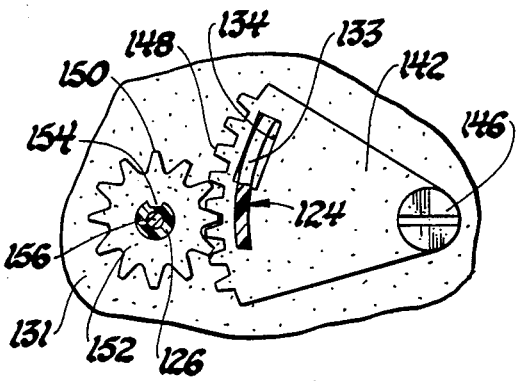
FIG. 10 is a view taken along the line 10—10 in FIG. 7.

Referring to FIG. 5, there is shown another form of vacuum type fluid pressure operated actuator constructed according to the present invention for similar use. The actuator again generally comprises a two-piece injection molded plastic casing 112 whose interior is divided by an elastomeric diaphragm 114 into a pair of chambers 116 and 118. The lower chamber 116 is vented to atmosphere and the upper chamber 118 is communicable with engine vacuum via a passage 120 through a right-angle nipple 121 integral with the upper side of the casing. The diaphragm 114 is normally biased by a conical helical spring 122 to the position shown in FIG. 5 when the chamber 118 is at or near atmospheric but on the establishment of a vacuum therein, the resulting differential pressure forces the diaphragm upward against the spring to an actuating position as shown in FIG. 7. As the diaphragm moves upwardly, a helical coupling assembly generally designated as 124 converts such linear motion into rotary motion of an output member 126 that is rotatably mounted on the lower side of the casing and is adapted to be connected to the device to be operated.

Figure 8:
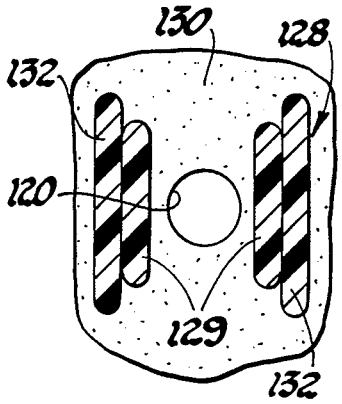
FIG. 8 is a view taken along the line 8—8 in FIG. 7.
Figure 6:
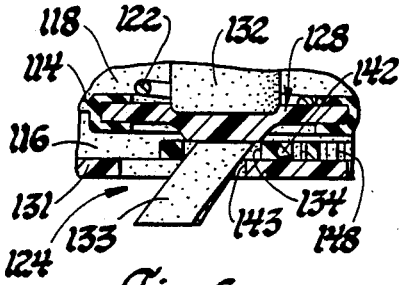
FIG. 6 is a view taken along the line 6—6 in FIG. 5.

Describing now the details of the helical coupling assembly 124, there is a coupling member 128 preferably made of injection molded plastic that is insert molded in the diaphragm 114 centrally thereof so as to extend therethrough and interlock therewith while preventing fluid from passing from one diaphragm side to the other between the chambers 116 and 118. The subassembly comprising the diaphragm 114 and coupling member 128 is simply assembled in the casing by compressing the periphery of the diaphragm between the two casing halves 130 and 131 which are then ultrasonically welded together. In this embodiment, the coupling member 128 and thereby the diaphragm 114 is required to move linearly without rotation by two parallel stems 132 that are formed integral with and extend upwardly from the coupling member. The stems 132 are received between and slide along parallel guide posts 129 formed integral with and extending downwardly from the upper casing part 130 at opposite sides of the passage 120. The posts 129 and stems 132 are of generally rectangular cross-section as seen FIG. 8 to prevent rotation of the coupling member and leave the passage 120 fully open to the chamber 118 rather than through a clearance fit as in the FIG. 1 embodiment.

In addition, the coupling member 128 has a centrally located, integral, helix 133 of generally rectangular cross-section extending downwardly from the other side of the diaphragm. The helix 133 slidably engages in a slot 134 of rectangular shape formed in the side of a sector gear 142 and extends therepast with clearance through an arcuate slot 143 in the side of the lower casing half 131. The sector gear 142 is rotatably mounted on the inner side of the lower casing half 131 on a post 144 formed integral therewith and is retained thereon by a screw 146. The teeth 148 on the sector gear 142 mesh with the teeth 150 of a substantially smaller diametrical pitch gear 152 that is secured by a tongue and groove joint 154 and a screw 156 to the output member 126. The output member 126 has a round collar 160 which is rotatably mounted in a round hole 162 in the lower casing half 131 and is retained therein by the small gear 152 which is thus also rotatably supported thereby. With the guide and anti-rotation stem 132 positively preventing any rotation of the diaphragm subassembly and when vacuum is applied to the chamber 118, the diaphragm assembly can thus only travel linearly which results in rotation of the output member 126 by operation of the helix 133 in the slot 134 turning the sector gear 142 and the latter in turn turning the other gear 152 connected to the output member and with the amount of output rotary motion thus directly proportional to the amount of vacuum supply. Then when the vacuum is relieved, the spring 122 operates to return the actuator to its normal position. In addition, different degrees of rotation of the output member can be obtained by simply providing the helix 133 with different pitches. Moreover, different degrees of rotation of the output member can also be obtained by simply providing the gears 142 and 152 with different diametrical pitches. In addition, by simply reversing the twist of the helix or thread 133, the actuator can be made to provide clockwise or counterclockwise rotation as desired.

It will also be appreciated that while the invention has been disclosed in its preferred form in a vacuum operated diaphragm type actuator, it may also be similarly used with a piston type actuator and where the motion conversion desired is from rotary to linear. Thus, the above described embodiments are intended to be illustrative of the invention which may be modified within the scope of the appended claim.

The embodiments of the invention in which an exclusive property or privilege is claimed are defined as follows:

1. A linear to rotary actuator having a fluid pressure operated diaphragm whose linear movement is translated into rotary movement of an output member by a helical coupling therebetween characterized by such coupling comprising a coupling member joined to the diaphragm so as to extend therethrough and interlock therewith while preventing fluid from passing from one diaphragm side to the other, said coupling member having a helix extending from one side of the diaphragm slidably engaging in a slot in the output member so as to effect rotary movement thereof with linear non-rotational movement of said coupling member, and said coupling member further having a centrally located stem of non-circular cross-section extending from the other side of the diaphragm slidably engaging a stationary guide in an elongated aperture therethrough, said guide and aperture having sides that cooperate to guide linear movement while preventing rotational movement of said coupling member and, the sides of said guide and aperture also cooperating to form a discrete singular fluid passage from the exterior of the actuator to said other side of the diaphragm.

* * * * *